United States Patent [19]

Gillespie

[11] Patent Number: 4,711,228

[45] Date of Patent: Dec. 8, 1987

[54] VERTICAL CROSS BOW AND REMOVABLE STOCK ASSEMBLY THEREFOR

[76] Inventor: Noah N. Gillespie, 58 Dobbins Rd., Waverly, Ohio 45690

[21] Appl. No.: 2,567

[22] Filed: Jan. 12, 1987

[51] Int. Cl.[4] ..... F41B 5/00

[52] U.S. Cl. ..... 124/25; 124/24 R; 124/DIG. 1

[58] Field of Search ..... 124/25, 24 R, 88, DIG. 1, 124/35 A, 41 A, 23 R, 89

[56] References Cited

U.S. PATENT DOCUMENTS

| | | | |
|---|---|---|---|
| 97,719 | 12/1869 | Sperry | 124/25 |
| 2,714,884 | 8/1955 | Ickes | 124/25 |
| 2,816,537 | 12/1957 | Irwin | 124/24 R |
| 3,483,857 | 12/1969 | Jones | 124/25 |
| 4,587,944 | 5/1986 | Barnett | 124/25 |
| 4,594,994 | 6/1986 | Williams | 124/25 |

FOREIGN PATENT DOCUMENTS

| | | | |
|---|---|---|---|
| 2053009 | 2/1981 | United Kingdom | 124/24 R |

*Primary Examiner*—Richard C. Pinkham
*Assistant Examiner*—Mark S. Graham
*Attorney, Agent, or Firm*—Norman B. Rainer

[57] ABSTRACT

A stock assembly is adapted to removably attach to the handle portion of an archery bow to convert the bow into a vertically oriented crossbow. The stock assembly has a laterally displaced gripping handle, and an elongated guide rod for constraining the path of movement of the bowstring to the path it would have in the absence of the stock assembly.

4 Claims, 4 Drawing Figures

VERTICAL CROSS BOW AND REMOVABLE STOCK ASSEMBLY THEREFOR

BACKGROUND OF THE INVENTION

This invention relates to archery bows, and more particularly to a stock assembly adapted to be removably attached to a compound bow or long bow to form a cross bow which, in the firing position, has a vertically disposed bow.

Conventional cross bows are comprised of a bow member adapted to be horizontally positioned, and an elongated stock member perpendicularly attached to the midpoint of the bow and extending in the direction of the bowstring. The bow member is usually a short stiff bow which can be drawn to its flexed state only by use of mechanical aids such as cranks and levers. The stock member generally has a trigger mechanism for engaging the bowstring, and a track upon which rides an arrow-like projectile referred to as a bolt. Unlike a conventional arrow whose length reaches between the midpoint of the bow and the bow string at full draw, a bolt is much shorter and therefore requires the track for guidance during firing.

Such conventional cross bows are generally slow and tiresome in repetitive firing situations. Also, problems are encountered holding the bolt in place when the cross bow is downwardly angled.

Long bows and compound bows, although usually less accurate than crossbows, are adapted to be drawn by hand without mechanical aids, and utilize conventional arrows. Accordingly, repetitive firing is faster than with a cross bow, and the arrow can be held in place in downward shooting angles.

In hunting situations, an archer must wait in a state of readiness while avoiding movement and making noise when the prey is within shooting distance. In most instances, the archer is awkwardly or precariously positioned in a concealed location such as a tree-mounted platform. The drawing of a bowstring under such circumstances may be difficult and may produce audible or visible alarm. However, the manual holding of a bowstring at a full draw readiness state for any appreciable length of time would be extremely wearisome. Although a conventional cross bow can be held indefinitely in a state of full drawn readiness, its horizontal format presents difficulties in manipulation and concealment.

It is accordingly an object of the present invention to provide an archery bow which combines the desirable features of cross bows with long bows and compound bows.

It is another object of this invention to provide a stock mechanism which can be removably attached to a long bow or compound bow to provide a cross bow.

It is a further object of the present invention to provide a stock mechanism of the aforesaid nature which transforms a long bow or compound bow into a cross bow wherein the bow member is vertically disposed in the normal firing position.

It is still another object of this invention to provide a stock mechanism of the aforesaid nature which is durable in construction, easy to use and economical to manufacture.

These and other objects and advantages of the invention will be apparent from the following description.

SUMMARY OF THE INVENTION

The above and other beneficial objects and advantages are accomplished in accordance with the present invention by a stock assembly adapted to be removably attached to the non-flexing handle portion of a bow having an arrow rest, said stock assembly comprising:

(a) an elongated rigid stock having a rearwardly disposed shoulder portion, and a forearm portion extending continuously from said shoulder portion to a forward extremity, said stock having opposed vertically disposed first and second side surfaces, (b) a trigger mechanism positioned at the juncture of said shoulder and forearm portions, (c) a gripping handle attached to said first side surface within said forearm portion and extending laterally away from said side surface, (d) attachment means associated with said forward extremity for removably attaching the stock assembly to the handle portion of the bow, (e) guide means for constraining the path of movement of the bowstring to the path it would have in the absence of said stock assembly, and (f) holding means for maintaining the nock of an arrow in contact with the bowstring held at full draw position by said trigger mechanism.

In a further aspect, the present invention contemplates a crossbow comprising a long bow or a compound bow having the aforesaid stock assembly attached thereto at the handle portion of the bow in a manner such that the bow is vertically disposed. In the case of a compound bow, the portion of the bowstring leaving the pulley wheels at the extremities of the flexible limbs and extending in the direction of the arrow is disposed upon the first side of the stock. The portion of the bowstring that crosses in the region between the handle of the bow and the extremities of the limbs is disposed upon the second side of the stock. The guide means may be a guide bar attached to the first side of the stock, or may be a slot running the interior length of the forearm portion.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
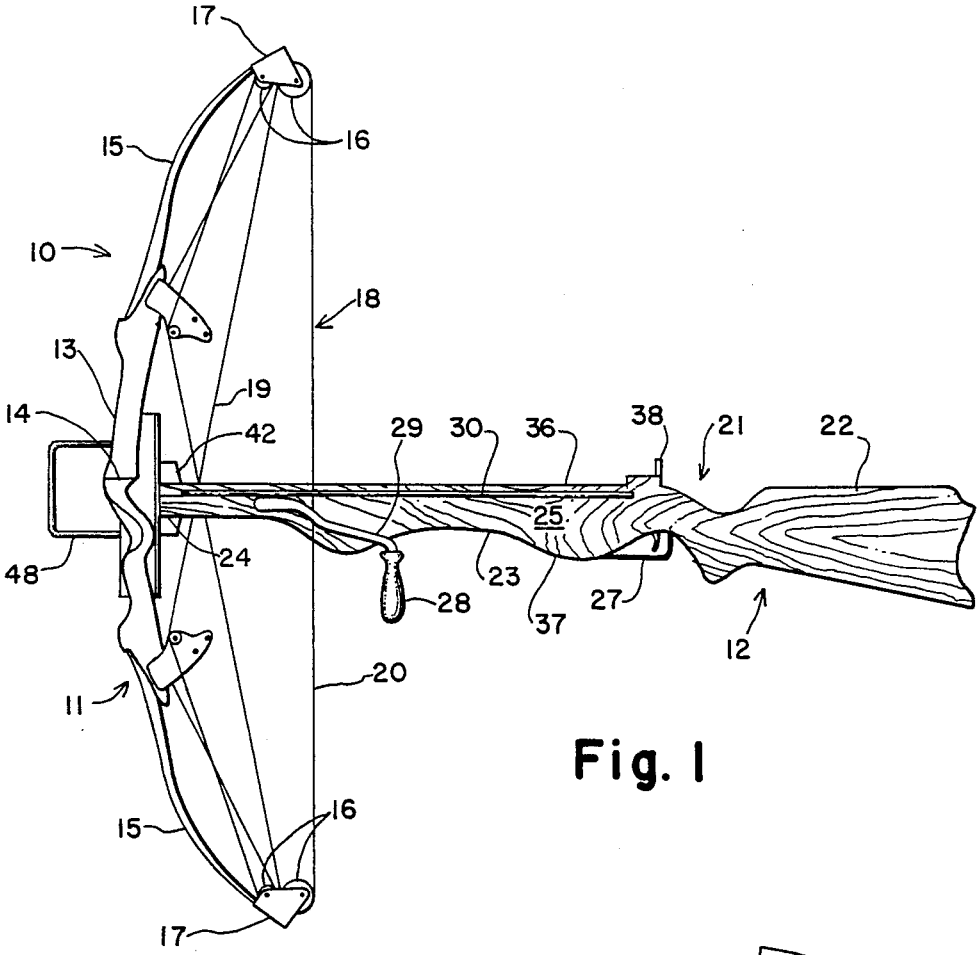
FIG. 1 is a side view of an embodiment of the cross bow with removeable stock assembly of the present invention, shown in an undrawn state.

For convenience of description, the expressions "forward" and "rearward" and terms equivalent thereto will have reference to the left and right extremities, respectively, of the crossbow shown in FIG. 1.

DESCRIPTION OF THE PREFERRED EMBODIMENT

Referring to the drawing, an embodiment of crossbow 10 of the present invention is shown comprised of a compound bow 11 having attached thereto stock assembly 12.

The compound bow is comprised of rigid handle portion 13 having arrow rest 14 disposed upon one side thereof. Paired spring-like metal limbs 15 are attached to the extremities of the handle. Paired pulley wheels 16 are associated with the free distal extremities 17 of the limbs. A bowstring 18 has its two extremities 35 anchored to the handle portion and extends to engagement with said pulley wheels, whereby the distance between said pulley wheels is traversed twice in crossing relationship 19 within the space embraced by the limbs, and traversed once in an outer wrap 20 adapted to be drawn rearwardly away from the bow.

The stock assembly is comprised of rigid elongated stock 21 which may be fabricated of materials such as wood, metal or plastic, and may be a monolithic structure or comprised of assembled component parts. The stock is comprised of rearwardly disposed shoulder portion 22, and forearm portion 23 extending continuously from said shoulder portion to a forward extremity 24. First and second side surfaces 25 and 26, respectively, are vertically disposed in opposed relationship. The forearm portion is further bounded by flat, horizontally disposed upper surface 36, and contoured lower surface 37.

A triger mechanism 27 of conventional design is positioned at the juncture of said shoulder and forearm portions, said mechanism extending through the interior of the stock and being adapted to hold and release the fully drawn bowstring. A peepsight 38 is positioned upon upper surface 36 in association with the trigger mechanism.

A gripping handle 28 is attached by offset bracket 29 to said first side surface within said forearm portion. The site of attachment of bracket 29 is forward of the position of outer wrap 20 of the bowstring in the braced but undrawn configuration of the bow. Handle 28 is disposed upon an axis substantially perpendicularly oriented to the long axis of the stock.

Guide means in the form of dowel rod 30 is mounted to said first side and slightly offset therefrom by spacer bolts 39, said dowel serving to constrain outer wrap 20 of the bowstring to movement along said first side.

Attachment means 31 is associated with forward extremity 24 and is adapted to cause bolted joinder of the bow and stock assembly. Said attachment means is comprised of vertically disposed sideplate 40 having forward and rearward portions 41 and 42, respectively, and vertically disposed end plate 43 perpendicularly emergent from sideplate 40. Forward portion 41 contains vertically spaced apertures 44 adapted to receive bolts 45 which engage threaded sockets (not shown) in handle portion 13 of the bow, said threaded sockets being in standardized positions specified by the Archery Manufacturers Organization. Rearward portion 42 contains apertures which receive bolts 46 which engage the stock through second side surface 26. End plate 43 contains apertures 47 which receive bolts that enter forward extremity 24 of the stock. By virtue of such bolting arrangement, the stock assembly may be securely and easily affixed to the bow in its vertical disposition. A foot stirrup 48 is attached to forward portion 41 in a manner to extend in front of the bow in a plane substantially parallel to the plane of the bowstring. By use of the foot stirrup, two hands may be employed to draw the bowstring back to locking engagement with the trigger mechanism.

Figure 2:
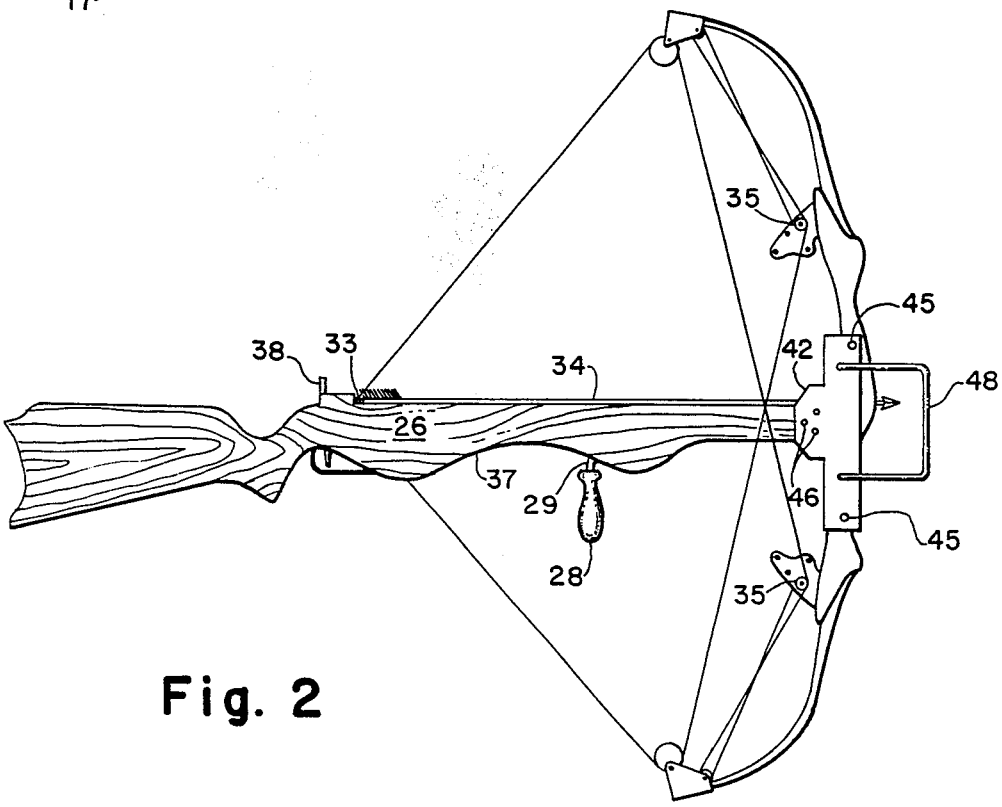
FIG. 2 is a view of the opposite side of the cross bow of FIG. 1 shown with an arrow in firing position and with the bow in its fully drawn state
Figure 4:
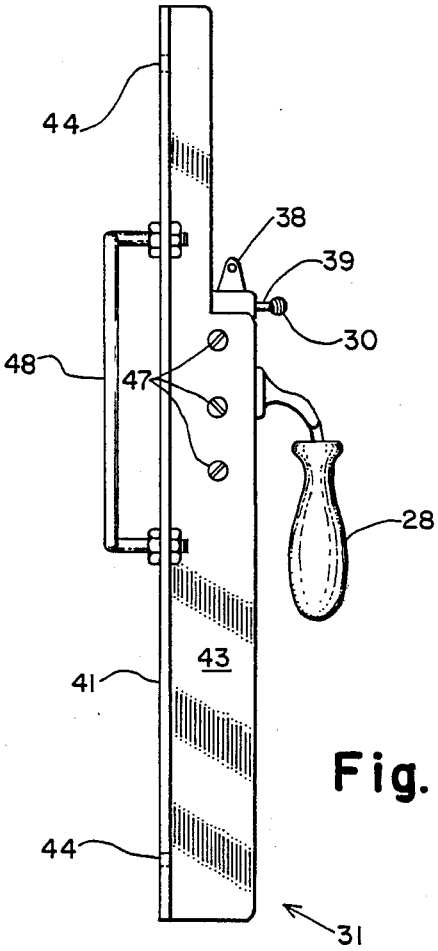
FIG. 4 is an enlarged front view of the stock assembly of FIG. 2.
Figure 3:
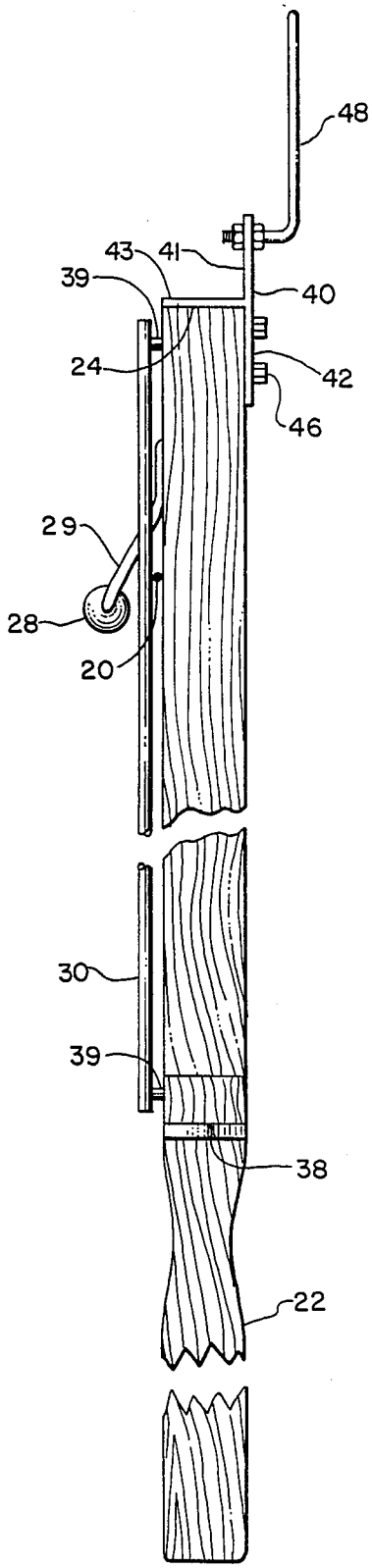
FIG. 3 is a top view of the stock assembly shown in FIG. 2.

FIG. 2 shows the positioning of an arrow 34 in the crossbow at full draw. The nock 33 of the arrow causes the arrow to be held by the bowstring with sufficient frictional force to prevent the arrow from falling away from the bowstring when the bow is downwardly inclined. The frictional holding force does not, however, impair the efficiency of the bow or performance of the arrow. It is to be noted that, with the bowstring held by the trigger mechanism at full draw, the front of the arrow rests upon the arrowrest in standard bow shooting manner. During shooting of the illustrated crossbow, which is designed for a right handed archer, the rear extremity of the shoulder portion will be placed against the archer's right shoulder, the right hand will be on the trigger, and the left hand will be holding handle 28.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention what is claimed is:

1. A crossbow comprising:

(a) a compound bow comprised of a rigid handle having an arrow rest disposed upon one side thereof, paired spring-like metal limbs attached to the extremities of the handle, paired pulley wheels associated with the free distal extremities of said limbs, and a bowstring having its extremities anchored to the handle and extending to engagement with said pulley wheels whereby the distance between opposed pulley wheels is traversed twice in crossing relationship within the space embraced by the limbs, and traversed once in an outer wrap adapted to be drawn rearwardly away from the bow, and (b) a stock assembly adapted to be removably attached to said handle to dispose said bow vertically, said stock assembly comprising:

(1) an elongated rigid stock of substantially monolithic construction having a rearwardly disposed shoulder portion, and a forearm portion extending continuously from said shoulder portion to a forward extremity, said stock having opposed first and second side surfaces, (2) a trigger mechanism positioned at the junction of said shoulder and forearm portions, (3) a gripping handle attached to said first side surface within said forearm portion and extending laterally away from said side surface, (4) attachment means for removably attaching the stock assembly to the handle of the bow, and comprised of a vertically disposed sideplate bolted to said second side surface and an end plate perpendicularly emergent from said sideplate and bolted to the forward extremity of said stock, and (5) guide means associated with the first side surface for constraining the path of movement of the outer wrap of the bowstring to the path it would have in the absence of said stock assembly.

2. The stock assembly of claim 1 wherein said side surfaces are vertically disposed during normal use of the stock assembly.

3. The stock assembly of claim 1 wherein said sideplate has a forward portion extending forwardly of said end plate and provided with spaced apart apertures for receiving bolts which enter the handle portion of the bow.

4. The stock assembly of claim 1 wherein a foot stirrup is attached to the forward portion of said sideplate.

* * * * *